US006241595B1

(12) United States Patent
Skinner

(10) Patent No.: US 6,241,595 B1
(45) Date of Patent: Jun. 5, 2001

(54) EDGER BLADE SHARPENER

(76) Inventor: Richard Skinner, 316 Little Beaver Dr., Grimes, IA (US) 50111

( * ) Notice: Subject to any disclaimer, the term of this patent is extended or adjusted under 35 U.S.C. 154(b) by 0 days.

(21) Appl. No.: 09/469,436

(22) Filed: Dec. 21, 1999

(51) Int. Cl.[7] ..... B24B 19/00

(52) U.S. Cl. ..... 451/419; 451/321; 451/349; 76/82.1

(58) Field of Search ..... 451/419, 321, 451/349; 30/351; 56/250; 76/82.1

(56) References Cited

U.S. PATENT DOCUMENTS 2,377,984 * 6/1945 Ward ..... 451/419
4,393,627 * 7/1983 Ailey, Jr. ..... 451/419
5,152,104 * 10/1992 Wood et al. ..... 451/269

* cited by examiner

*Primary Examiner*—Joseph E. Hail, III
*Assistant Examiner*—George Nguyen
(74) *Attorney, Agent, or Firm*—John D. Gugliotta

(57) ABSTRACT

This invention is a sharpening device for lawn edger blades. The device is specifically designed for attachment to the machine and in use for when the machine is in operation. The reason for this is to keep the cutting edge of the blade continually sharp. The attachment is positioned near the cutting edge and sharpens the blade as it rotates. A manual switch or lever activates the sharpener as the user desires. The sharpener includes a caliper with an abrasive surface to squeeze against the rotating blade while the edger is in operation.

6 Claims, 5 Drawing Sheets

EDGER BLADE SHARPENER

RELATED APPLICATIONS

There are no previously filed, nor currently any co-pending applications, anywhere in the world.

BACKGROUND OF THE INVENTION

1. Field of the Invention

The present invention relates generally to blade sharpening devices and, more particularly, to a blade sharpening device for lawn edgers.

2. Description of the Related Art

In the prior art, devices for sharpening the blades of power equipment such as lawn mowers are well known. However, absent in the art are any such devices particularly designed for the sharpening of the blades of powered lawn edging equipment.

Many Americans spend countless hours maintaining and beautifying their lawns and landscape. As a matter of pride and personal expression, these people manicure their grass, plant and maintain flowers, shrubs, bushes and trees all for the sake of enhancing the aesthetic qualities of their property. In performing these tasks one uses a variety of tools and machinery, each of which performs a specialized yard care or maintenance function. Among these devices, the lawn edger is among the most popular. One of the essential steps in maintaining one's yard consists of trimming the grass border that abuts with the driveway or sidewalk, etc. In doing so, the border is given a straight, uniform look rather than overlapping the adjoining areas. Motorized edgers are of a great help in performing this task. These edgers consist of a wheeled device that includes a blade that is spun, in a vertical orientation, by a gas-powered engine or electric motor. The edger includes a handle that allows the user to push the device along the edge of the grass to be trimmed with great ease and control while the spinning blade trims the edge of the grass line in a neat, uniform manner. One problem with these devices, however, is that the blade tends to dull quickly as it passes through a great deal of dirt during typical use. The dirt acts as an abrasive that serves to dull the blade. As a result, one must routinely remove the blade in order to sharpen it, consuming a great deal of time and effort.

Accordingly, there is a need for a means by which lawn edger blades can be maintained in a uniform, sharpened manner without unnecessarily inconveniencing the user. The development of the Stay Sharp lawn edger fulfills this need.

A search of the prior art did not disclose any patents that read directly on the claims of the instant invention; however, the following references were considered related:

| U.S. Pat. No. | Inventor | Issue Date |
|---|---|---|
| 5,549,508 | Searle et al. | August 27, 1996 |
| 4,936,053 | Shanelec | June 26, 1990 |
| 4,694,613 | Bernhard | September 22, 1987 |
| 4,148,158 | Hewitt | April 10, 1979 |
| 3,636,666 | Brayman | January 25, 1972 |
| 3,659,385 | Ferguson | May 2, 1972 |
| 2,879,629 | Machovic | March 31, 1959 |
| 5,371,977 | Liner | December 13, 1994 |
| 4,265,146 | Horrell | May 5, 1981 |
| 5,062,322 | Sinko | November 5, 1991 |
| 4,509,316 | Edwards | April 9, 1985 |

SUMMARY OF THE INVENTION

It is therefore an object of the present invention to provide an apparatus for sharpening the blades of a conventional powered lawn edger.

It is a feature of the present invention to be able to be installed on new lawn edgers and retrofitted on existing lawn edgers.

It is another feature of the present invention to provide a motorized operation that is easy to use, convenient and efficient.

It is yet another feature of the present invention to sharpen blades automatically.

It is still yet another feature of the present invention to provide a handle mounted trigger actuation.

It is yet still another feature of the present invention to greatly reduce the time required of manual sharpening.

Briefly described according to one embodiment of the present invention, the Edger Blade Sharpener is a blade sharpening mechanism that is used to maintain the blade of an otherwise conventional motorized lawn edger lawn in a sharpened condition without requiring removal of the blade or manual sharpening. The blade is sharpened by a pair of sharpening stones that are supported by a caliper-type mechanism such that they lie one on each side of the blade. Activated by squeezing a trigger located on the edger handle, the calipers converge upon the blade, forcing the sharpening stones into contact with the edger blade as it is spun by the motor. As the blade turns, it is sharpened automatically, relieving the user of the need to perform any manual sharpening operations on the blade. As a result, use of the Edger Blade Sharpener allows the user to obtain the benefits of a motorized edger device without the hassle of blade maintenance.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

LIST OF REFERENCE NUMBERS

| | | | |
|---|---|---|---|
| 5 | Conventional Powered Rotary Lawn Edger | 20 | Caliper Arm |
| | | 20a | Spring |
| 5a | Edger Blade Housing | 21 | Sharpening Pads |
| 10 | Stay Sharp Blade Sharpener | 21a | Bolt |
| 11 | Housing | 21b | Tab |
| 16 | Strap | 21c | Sharpening Stone |
| 16a | Aperture | 22 | Plate |

-continued

| LIST OF REFERENCE NUMBERS | | | |
|---|---|---|---|
| 16b | Aperture | 22a | Tab |
| 17 | Cable | 22b | Aperture |
| 17b | Cable Aperture | 25 | Trigger |
| 18 | Arbor | 25a | Clamp |
| 19 | Crank Arm | 26 | Blade |
| 19a | Pin | | |

DESCRIPTION OF THE PREFERRED EMBODIMENTS

The best mode for carrying out the invention is presented in terms of its preferred embodiment, herein depicted within the following Figures.

1. Detailed Description of the Figures

Figure 1:
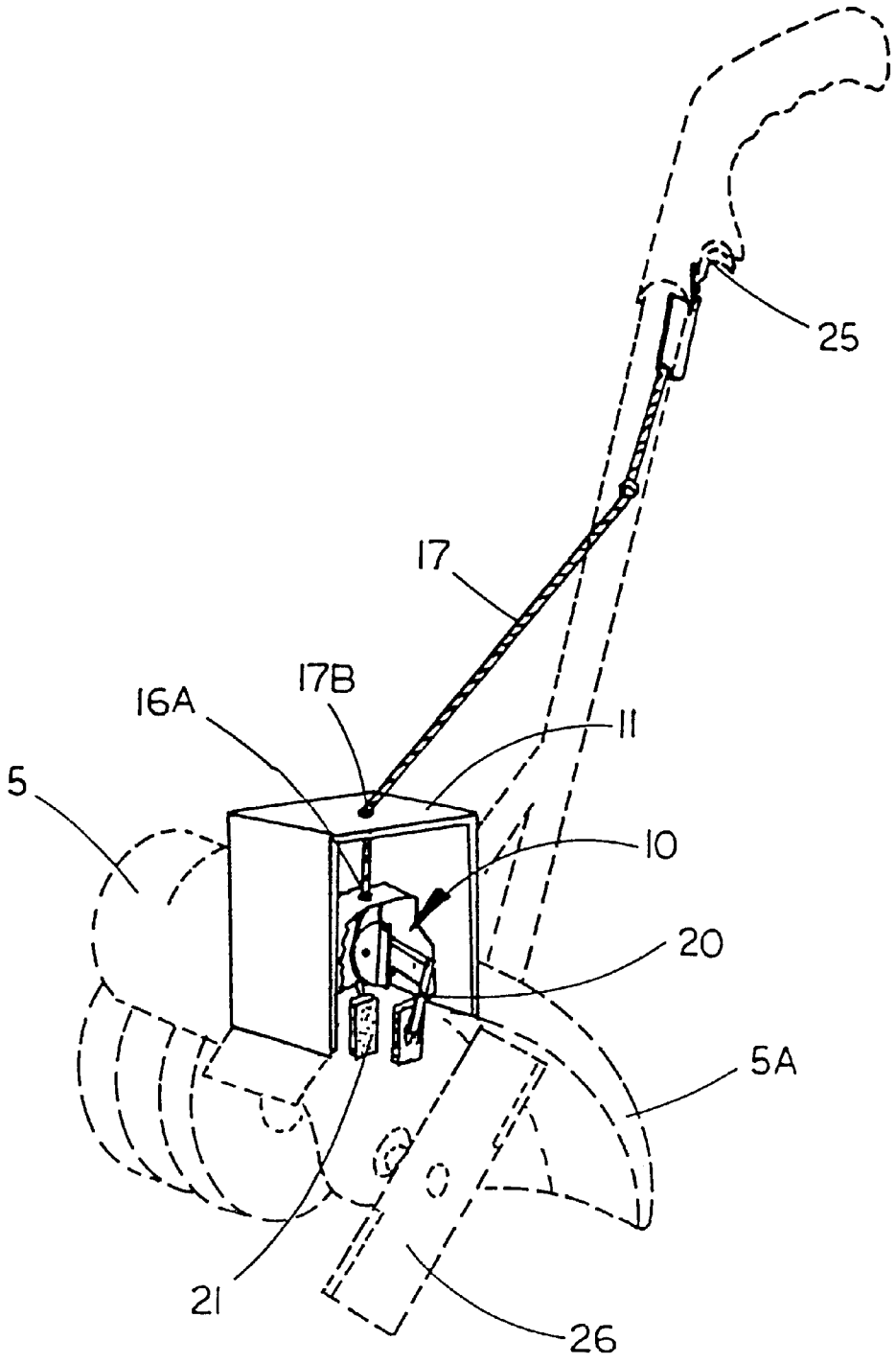
FIG. 1 is a perspective view of a conventional lawn edger with an Edger Blade Sharpener installed, according to the preferred embodiment of the present invention.

Referring to FIG. 1, a perspective view of a conventional powered rotary edger 5 (not part of the disclosure) is shown with an Edger Blade pener 10 installed. Edger 5 may be powered by either a gasoline or electric motor typically mounted on top of a housing containing a gear box with a sidewardly extending rotating shaft protruding therefrom. This is the shaft which rotates a blade in the vertical plane for trimming the turf along the edge of a sidewalk or driveway. Also typical is a wheel connected to the housing for rollably supporting edger 5 on the sidewalk or driveway.

A trigger 25 is connected to the handle of edger 5 via clamp 25*a* (not shown) and located within convenient reach of the user. Connected to trigger 25 is a cable 17 for transmitting the user's draft on trigger 25 to the operating mechanism of the Edger Blade Sharpener 10 via cable 17. Whenever the user desires to sharpen the rotating blade of edger 5, one need only pull trigger 25 for a short period of time until it is felt that the edger's blade has been sufficiently sharpened.

Figure 2:
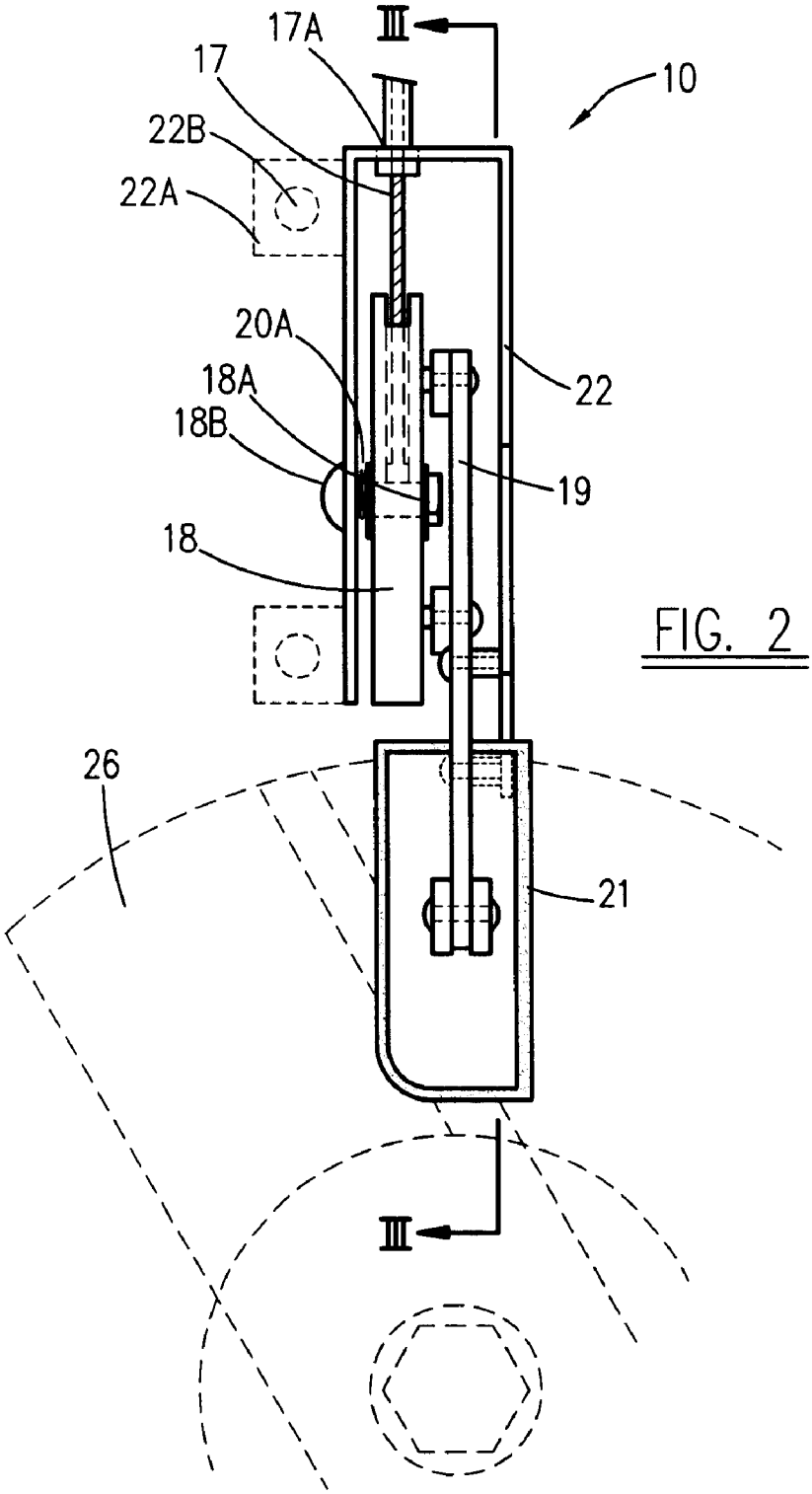
FIG. 2 is an cutaway view of a conventional lawn edger with an Edger Blade Sharpener installed taken along line III—III of FIG. 3, according to the preferred embodiment of the present invention.

Referring to FIG. 2, cable 17 penetrates edger blade housing 5*a* at aperture 17*b* and is connected to bell crank 18 rotatably supported by arbor 18*a* as shown. Arbor 18 is mounted on and supported by a unshaped plate 22 via bolt 18*b*. Plate 22 is mounted to the outer sidewall of edger housing 5 a via tabs 22*a*. It is envisioned that self tapping screws or bolts would be used to mount plate 22 to the outer sidewall of housing 5*a*.

Figure 3:
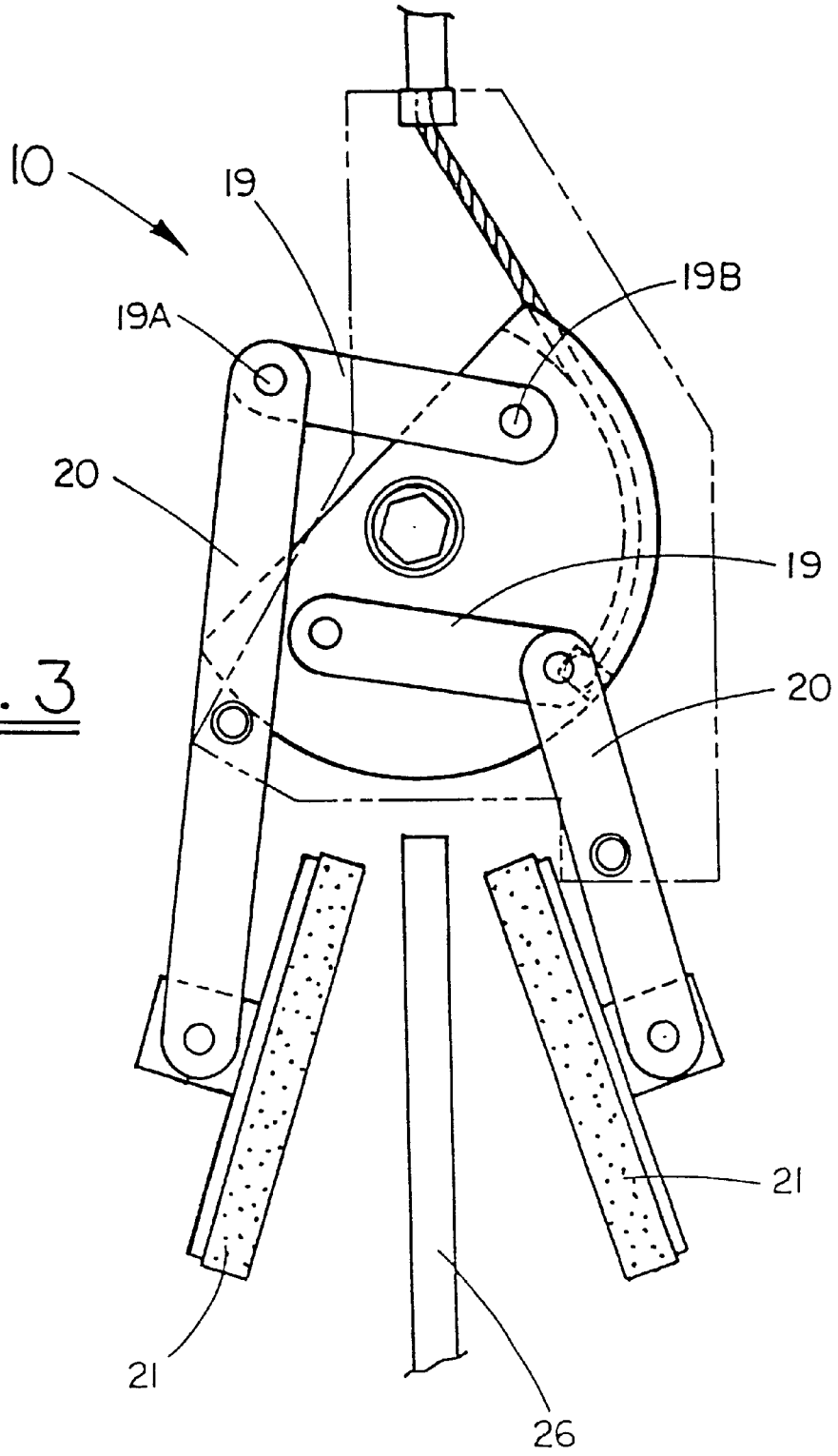
FIG. 3 is a cross sectional view taken along line III—III of FIG. 2.

FIG. 3 shows the Edger Blade Sharpener 10 with caliper arms 20 in the open configuration. Cam 18 is designed to transmit and convert the linear motion of cable 17 to a rotary motion to create the inopposite linear motion necessary to drive a pair caliper arms 20 linked to cam 18 via a pair of crank arms 19. Crank arms 19, cam 18, and caliper arms are all movably linked to each other via pins 19*a*. Consequently, caliper arms 20 are driven toward each other when cable 17 is pulled via trigger 25. A spring 20*a* (best seen in FIG. 2) biases bell crank 18 in a clockwise direction keeping caliper arms 20 normally separated. At the lower end of each of said pair of caliper arms 20 is a sharpening pad 21 pivotally connected via a bolt 21*a* and pair of tabs 21*b* in the arrangement as shown. Each sharpening pad 21 has located on its inner side a sharpening stone 21*c*. Sharpening pads 21 are attached via bolts 21 so that they may be removed and replaced as required. As with all sharpening devices sharpening stone 21*c* will require periodic replacement. Blade 26 would normally pass unobstructed or touched by sharpening pads 21. The entire assembly is then enclosed in a housing 11.

It is envisioned that the edger blade sharpener 10 can be sold in a kit for aftermarket installation in which case edger housing 5*a* may have to be modified slightly by cutting to retrofit the entire assembly as shown. It is also envisioned that edger blade sharpener 10 can also be installed at the factory when edger 5 is made.

Figure 4:
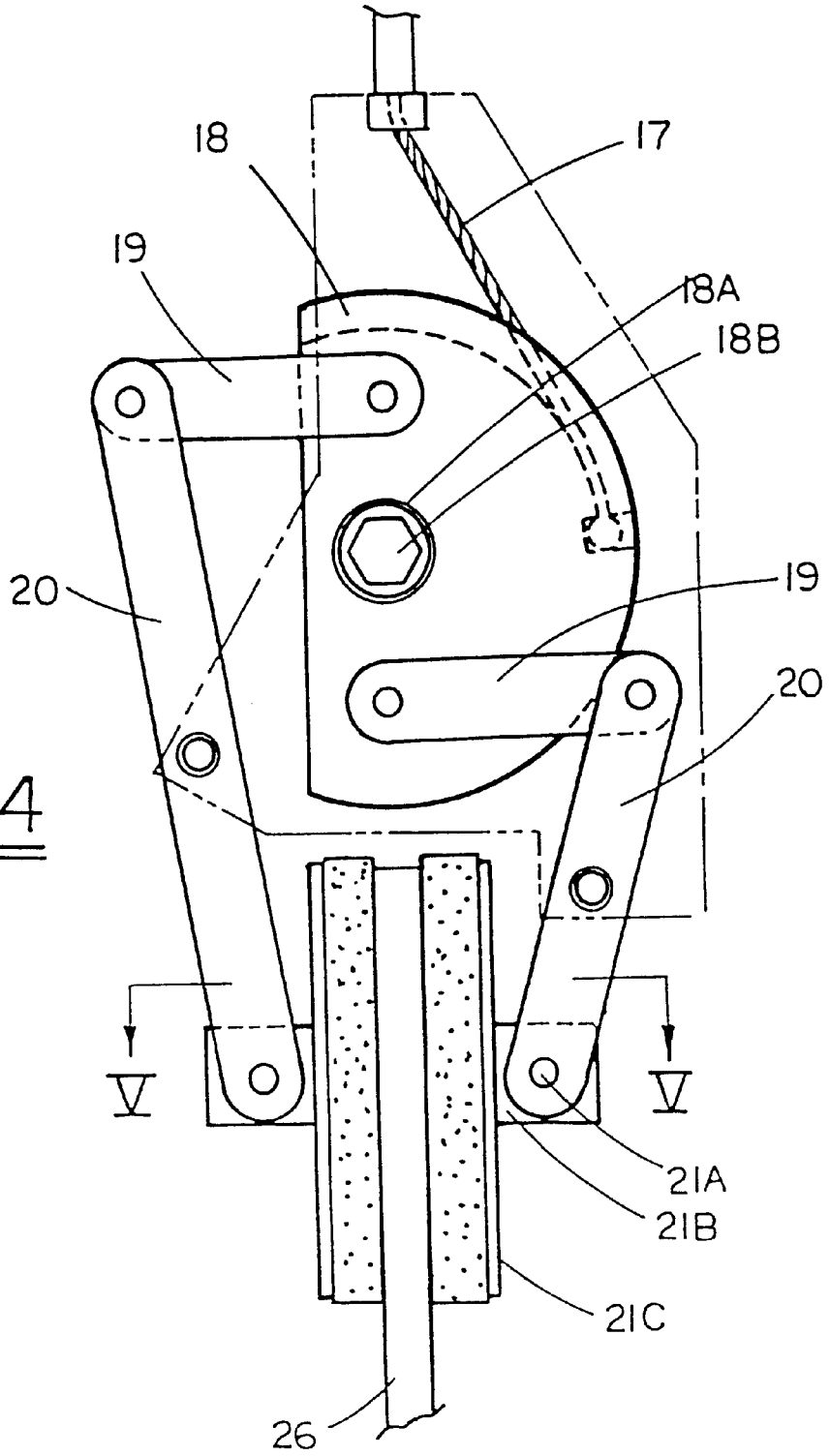
FIG. 4 is a front view of the operating mechanism of an Edger Blade Sharpener in the closed configuration, according to the preferred embodiment of the present invention.
Figure 5:
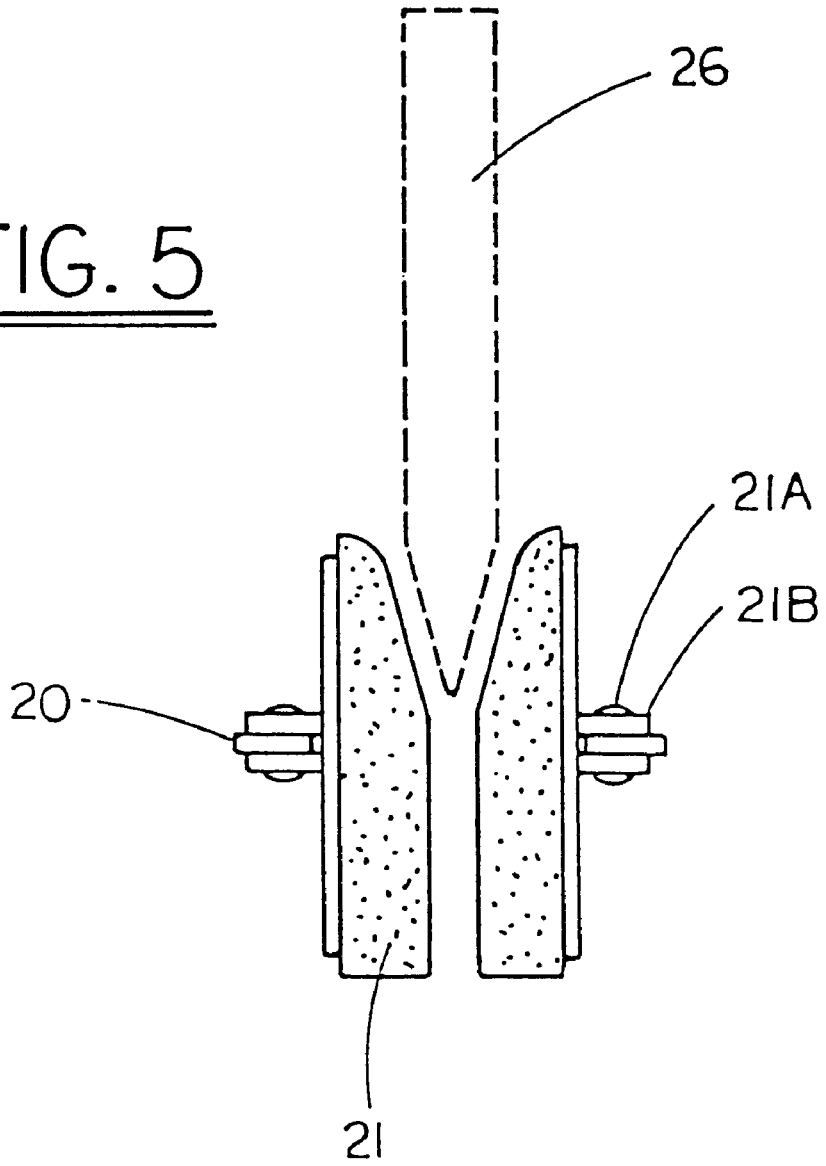
FIG. 5 is an side view of the sharpening stones from an Edger Blade sharpener illustrating their relationship to the rotating blade of a conventional lawn edger, according to the preferred embodiment of the present invention.

FIG. 4 shows the Edger Blade Sharpener 10 with caliper arms 20 in the closed configuration as when trigger 25 is pulled. The rotation of cam 20 in a counter-clockwise direction forces caliper arms 20 towards each other forcing sharpening pads 21 to be in a position such that rotating blade 26 will make contact with the outer surface of sharpening stones 2*c*. Sharpening stones 21*c* have an inwardly tapered surface to guide blade 26 as it passes between the pair of sharpening stone 21*c*. The sharpening stones 21 contacting the blade has the effect of grinding the blade and sharpening it. This is illustrated more clearly in FIG. 5.

Sharpening stones 21 can be ma de from any of the conventional materials that sharpening stones or pads are made from. The only requirement here is that the material selected can be used for sharpening steel blades and formed into the shape as described. The sharpening stones are then attached via a high strength adhesive or other suitable means to sharpening pads 21.

The foregoing description is included to illustrate the operation of the preferred embodiment and is not meant to limit the scope of the invention. The scope of the invention is to be limited only by the following claims.

2. Operation of the Preferred Embodiment

To use the Edger Blade Sharpener and sharpen the rotating blades, one need only pull a trigger located on the handle of a conventional lawn edger. The trigger is connected to a cable which pulls on a crank arm on the calipers of the sharpening apparatus. Specially designed sharpening stones are pulled gently together for engaging the cutting surfaces of the rotating edger blade. As the blade passes between the sharpening stones their cutting edges are sharpened by the abrasive sharpening stones. Once the operator feels the blades have been sharpened enough, the trigger is released and the edging operation may continue. The sharpening stones are removably attached to the caliper assembly for periodic replacement.

What is claimed is:

1. An apparatus for sharpening a rotating blade of a powered lawn edger, comprising:

a trigger, said trigger connected to the handle of said edger via a clamp and located within convenient reach of the user for transmitting draft to a cable;

a cable, said cable connected to said trigger for transmitting said user's draft on said trigger to the operating mechanism of said apparatus;

an edger blade housing;

a u-shaped plate, said u-shaped plate mounted to an outer sidewall of said edger housing via tabs;

an arbor, said arbor mounted on and supported by said u-shaped plate via a bolt;

a pair of caliper arms; said pair of caliper arms driven toward each other when said cable is pulled via said trigger;

a cam, said cam rotatably supported by said arbor and designed to transmit and convert a linear motion of said cable to a rotary motion to create an opposed linear motion necessary to drive said pair of caliper arms;

a pair of crank aims; said pair of crank arms for linking said caliper arms to said cam and wherein said pair of crank arms, said cam and said caliper arms are movably linked to each other via pins;

a spring, said spring for biasing said cam in a clockwise direction keeping said caliper arms normally separated;

a pair of sharpening pads, said pair of sharpening pads pivotally connected at the lower end of each of said caliper arm via bolts and a pair of tabs and wherein each sharpening pad has located on its inner side a sharpening stone; and a housing, said housing for enclosing said apparatus.

2. The apparatus for sharpening the rotating blade of a powered lawn edger of claim 1, wherein the rotation of said cam in a counter clockwise direction forces said pair of caliper arms towards each other forcing said sharpening pads to be in a position such that a rotating blade will make contact with an outer surface of said sharpening stones wherein the contacting blade has the effect of grinding said blade and sharpening it.

3. The apparatus for sharpening the rotating blade of a powered lawn edger of claim 2, wherein said sharpening stones have an inwardly tapered surface to guide said blade as it passes between said pair of sharpening stones.

4. The apparatus for sharpening the rotating blade of a powered lawn edger of claim 3, wherein said sharpening stones can be made from any of the conventional materials that sharpening stones or pads are made and then attached via a high strength adhesive or other suitable means to said sharpening pads.

5. The apparatus for sharpening the rotating blade of a powered lawn edger of claim 4, wherein said sharpening pads may be removed and replaced as required.

6. The apparatus for sharpening the rotating blade of a powered lawn edger of claim 5, wherein whenever the user desires to sharpen said g blade, one need only pull said trigger for a short period of time until it is felt that said edger's blade has been sufficiently sharpened.

* * * * *